United States Patent [19]

Germain

[11] 4,280,727

[45] Jul. 28, 1981

[54] INJECTION MOLDED SNOW SHOVEL

[75] Inventor: Robert A. Germain, Ashtabula, Ohio

[73] Assignee: True Temper Corporation, Cleveland, Ohio

[21] Appl. No.: 83,260

[22] Filed: Oct. 10, 1979

[51] Int. Cl.[3] ..... E01H 5/02

[52] U.S. Cl. ..... 294/54; 37/53

[58] Field of Search ..... 294/54, 55, 49, 51, 294/52, 53, 58; 37/53, 41, 162, 130, 134

[56] References Cited

U.S. PATENT DOCUMENTS

| | | | |
|---|---|---|---|
| 281,158 | 7/1883 | Stegner | 294/54 |
| 4,125,951 | 11/1978 | Huerth | 294/54 |
| 4,149,744 | 4/1979 | Bonnes | 294/54 |

*Primary Examiner*—James B. Marbert

*Attorney, Agent, or Firm*—Baldwin, Egan, Walling & Fetzer

[57] ABSTRACT

A one piece plastic injection molded snow shovel in which the blade, synthetic plastic handle stem and D-top handle are molded in one operation and a finished unit is produced from one cycle of the molding machine. A generally rectangular scoop of synthetic plastic has an integral generally cylindrical hollow handle stem extending centrally outwardly from the rear edge of the scoop. One embodiment has an inwardly reinforced cylindrical stem extending inward of the scoop for several inches from the back edge and then outward for a space normally grasped by a hand of the shoveller. A second embodiment has the handle stem entering from the back of the scoop with a section including an arcuate shell having an arc between about 220°-235° and with a central reinforcing rib diametetrically of the arc. In either case, much of the outwardly extending handle stem consists of upwardly opening arcuate shell between about 220°-235° together with an upper face of an open X-crossing structure making a light but strong handle. A third embodiment has a hollow cylindrical handle stem of which almost the entire length has a plurality of spaced longitudinally extending short reinforcing projections extending radially inwardly.

6 Claims, 16 Drawing Figures

INJECTION MOLDED SNOW SHOVEL

FIELD OF THE INVENTION

The field of art of this invention is hand operated snow excavators and plate lifters of snow shovel-type.

DESCRIPTION OF THE PRIOR ART

The known prior art includes U.S. Pat. No. 4,149,744 granted Apr. 17, 1979 to David R. Bonnes for a Snow Shovel including a one-piece plastic scoop formed of a minimum amount of material so as to resist wear and breakage effectively. It has a reinforced flange at the scraping edge and a centrally-disposed reinforcing keel or rib on its back surface extending from the leading edge to its handle-receiving socket. This socket is intended to receive a handle which may be wood or plastic. Also, U.S. Pat. No. 4,125,951 granted Nov. 21, 1978 to Arthur W. Huerth is for a Snow Removal Device without stooping, bending or lifting. This device is intended to be pushed across pavement to remove the snow without lifting. A smooth surface on the interior of the device enables disposal of accumulated snow by rapidly pushing or slinging the device, thereby propelling the snow forward and out of the device.

SUMMARY OF THE INVENTION

One embodiment provides a handle stem integral with the blade of the scoop and extending approximately twelve inches from the back end of the blade into the scoop and about eight inches outward from the back end of the scoop; this portion of the handle stem being reinforced with ribs internally to provide strength. A core pull is provided for this portion of the handle structure with a draft permitting the pulling of the core longitudinally of the handle stem from the scoop end. The rest of the handle of this embodiment is formed by utilizing a slightly over semi-circular half round on the bottom side of the stem and with the top having a lattice work effect with criss-crossing ribs to provide adequate strength with minimum of weight and necessitating no core pull in this area. A second embodiment has a handle stem structure extending from the handled-attached edge inward consisting of an arcuate shell extending a little more than semi-circular opening downwardly with a central diametrically extending rib extending to the circular limit of said arc, the rest of said handle stem being of an open criss-crossing structure. A third embodiment provides a hollow handle stem integral with the scoop blade and extending from the grip portion at the outer end of the handle stem approximately to the bottom side of the scoop. A one-piece core pull is provided to form this embodiment and this core pull is intended to be machined with internal ribs to provided the necessary stiffness and strength to the handle structure. The hollow portion of the handle stem is tapered from the grip end of the stem to the rear end of the scoop using the minimum taper needed for core removal longitudinally of the stem from the scoop end thereof.

DESCRIPTION OF THE PREFERRED EMBODIMENTS

Figure 1:
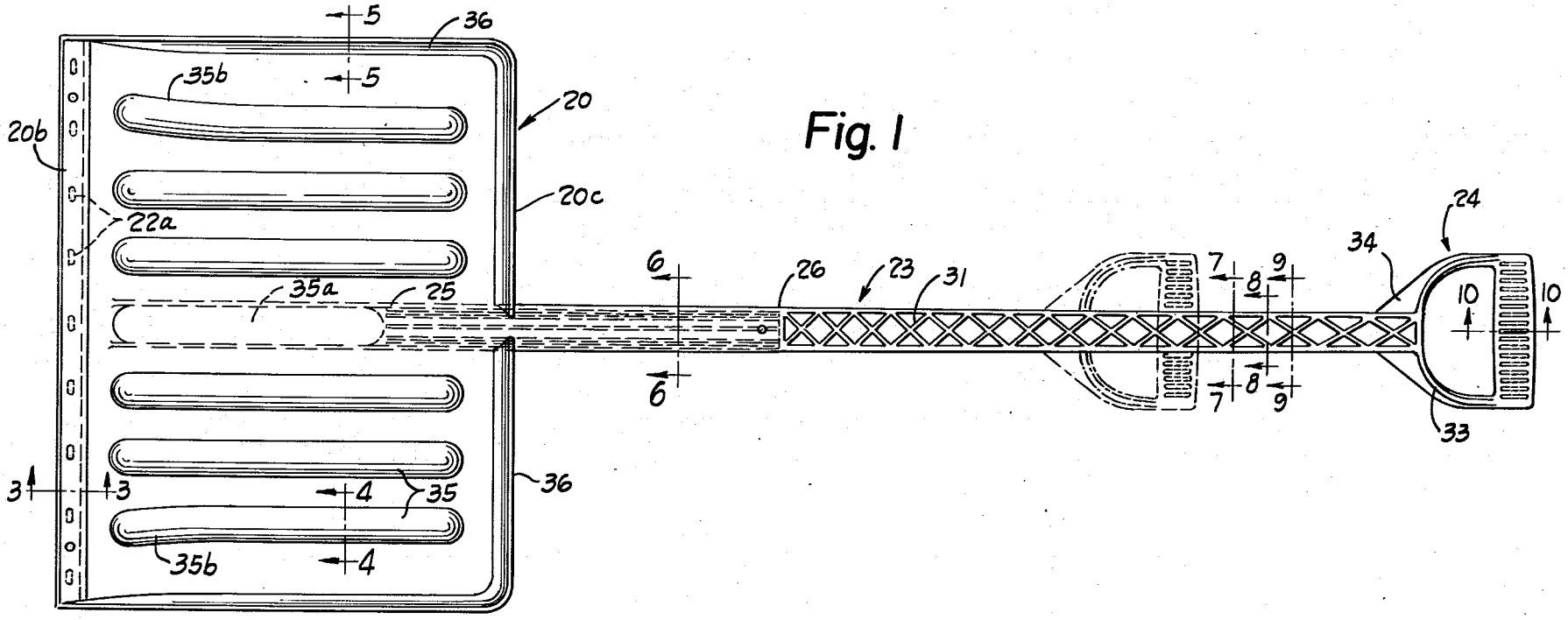
FIG. 1 is a top plan view of a first embodiment of this invention.
Figure 2:
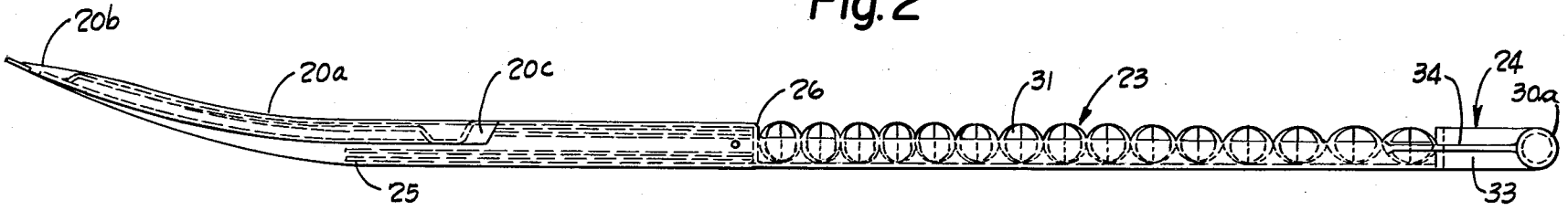
FIG. 2 is a side elevational view of FIG. 1.
Figure 3:
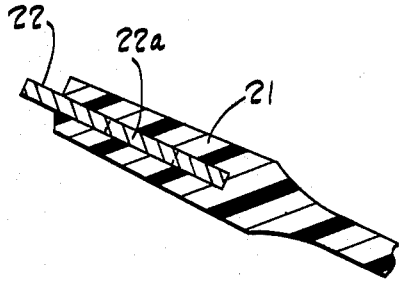
FIGS. 3, 4 and 5 are sectional views enlarged taken along similarly numbered section lines of FIG. 1.

Referring to FIGS. 1 and 2, a first embodiment of this invention includes a generally rectangular scoop or blade 20 having a slightly concave upper surface as indicated at 20*a* in FIG. 2 and having a transverse leading edge 20*b* opposite a handle-attached edge 20*c*. A bifurcated reinforcement strip 21 (FIG. 3) extends along the entire length of the leading edge 20*b*. A flat linear metal strip 22 is firmly secured at 22*a* in the bifurcation of the reinforcement strip 21 as best seen in FIG. 3. This metal strip extends beyond the front edge of the reinforcement strip 21 and is a great aid in cleaning snow and ice from a surface.

Figure 6:
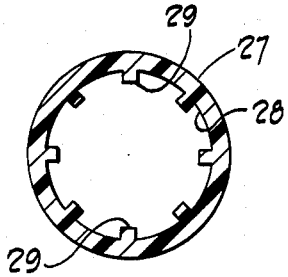
FIG. 6 is a sectional view of the hand grip portion taken along the line 6—6 of FIG. 1.

A generally cylindrical hollow handle stem structure 23 extends centrally of the scoop 20 at right angles to the leading edge, from a point on said scoop adjacent the leading edge to a position on the handle stem for a handle grip 24 spaced from the handle-attached edge. This hollow handle stem structure is integral with the scoop structure of the scoop or blade 20. The hollow handle stem structure has a reinforced length beginning at a point a few inches inside of the handle attached edge as indicated at 25 and this length extending outwardly for a space ending at 26 in FIG. 1 to encompass that portion of the handle normally grasped by the hand of an active snow shoveller and which in one embodiment extends eight inches beyond the edge 20*c* of the scoop. This portion of the hollow stem structure has an outer cylindrical shell 27 (FIG. 6), and spaced inwardly therefrom at about 0.125 inches an inner wall structure 28, also cylindrical. In molding this portion of the handle stem, an inner core is provided in this length from 25 to 26 of a shape to form spaced longitudinal reinforcing projections 29 extending a short distance, in one embodiment 0.080 inches, inwardly from the wall of the hollow stem structure. This length from 25 to 26 in FIG. 1 decreases in diameter continuously and regularly outwardly from the point 25 by an amount of draft permitting a forming core to extend through this length and to be removed longitudinally of the handle stem structure from the scoop end. Such amount of draft in one embodiment is about 2°.

Figure 9:
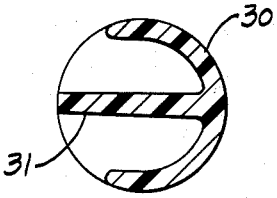
FIG. 9 is a sectional view taken along the line 9—9 of FIG. 1.
Figure 8:
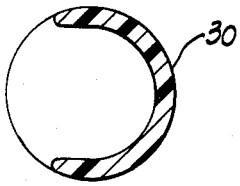
FIG. 8 is a sectional view taken along the line 8—8 of FIG. 1.
Figure 7:
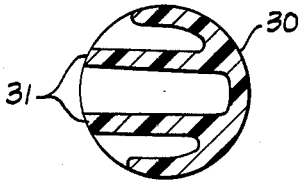
FIG. 7 is a sectional view taken along the line 7—7 of FIG. 1.
Figure 10:
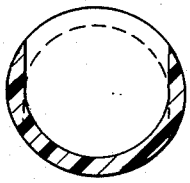
FIG. 10 is a sectional view taken along the line 10—10 of FIG. 1.

The handle stem structure shown in FIGS. 1 and 2 from the point 26 outwardly consists of a lower arcuate shell 30*a*, as seen in section in FIGS. 7, 8 and 9 which extends through an arc a little more than semi-circular opening upwardly. This portion of the handle stem is completed on the upper face by an open X-crossing structure 31, repeated longitudinally in one embodiment at intervals of about one and one-eighth inches to one and one-half inches, and this crossing structure is of a length to reach the circular limit of the arc 30*a* as seen in FIGS. 7, 8 and 9.

The handle grip portion indicated at 24 in FIGS. 1 and 2, is formed by a handle grip bar 30 which is about one and one-eight inches in outside diameter and about one inch inside diameter and the bar is formed by use of a central core extending longitudinally through the bar 30 and removable after injection of the mold by pulling the core longitudinally out one end of the bar 30. This bar 30 is connected with the handle stem by U-shaped member 33 preferably with an outwardly extending reinforcing flange 34 connected between opposite ends of the bar member 30 and the handle stem structure, as clearly seen in FIGS. 1 and 2.

Figure 4:
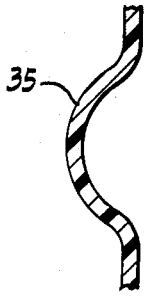

As shown in FIG. 1, a plurality of laterally spaced reinforcement ribs are formed concavely upward in the upper surface of the scoop 20 and extending between the edges at right angles thereto and including a central rib 35*a* and evenly spaced ribs 35 generally parallel and spaced laterally thereof. These ribs 35, other than the central rib 35*a*, gradually increase in depth from a minimum depth adjacent the leading edge 20*b* to about one-half inch depth, as seen in FIG. 4, at a predetermined short distance from the handle-attached edge 20*c*. Preferably, but not necessarily, the outer most ribs 35 may be inclined laterally outwardly a slight amount near the leading edge as seen at 35*b* in FIG. 1.

Figure 5:
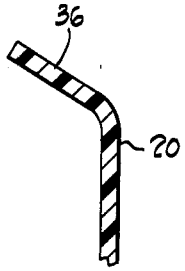

As seen in FIGS. 1 and 5, a snow-retaining and reinforcing flange 36 extends upwardly from the periphery of the scoop except for the leading edge 20*b*.

Figure 11:
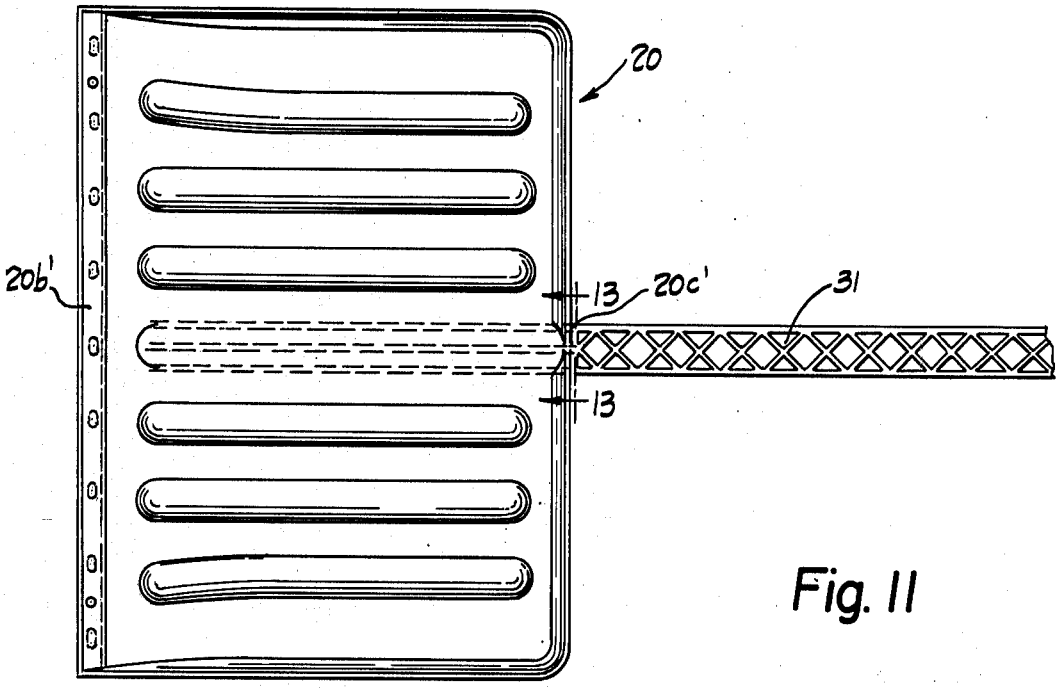
FIG. 11 is a fragmental top plan view of a second embodiment of this invention of which all parts of the scoop are approximately the same as those shown in FIG. 1 and the changes being in the construction of the handle stem.
Figure 12:
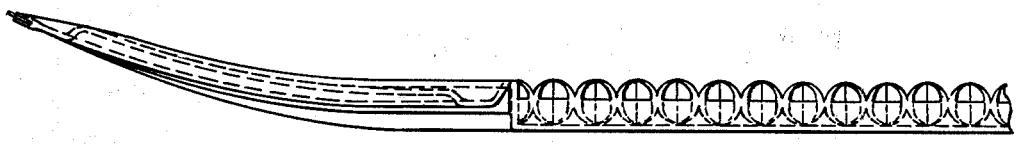
FIG. 12 is a fractional side elevational view of FIG. 11.
Figure 13:
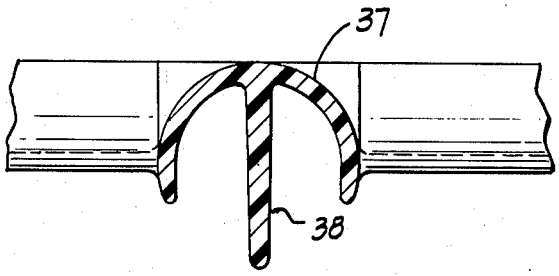
FIG. 13 is a sectional view taken along the line 13—13 of FIG. 11.

A second embodiment of the invention is shown in FIGS. 11 through 13. This is like the first embodiment described in connection with FIGS. 1 and 2 in all respects except for the handle stem structure.

As seen in FIG. 11, the handle stem structure from the handle-attached edge 20*c*′ forward to a point adjacent the leading edge 20*b*′ is of a cross section shown in FIG. 13. There the upper surface of the handle stem structure is formed by an arcuate structure 37 which is a little more than semi-circular in extent and is convex upwardly. Diametrically of the arcuate portion 37 is an integral reinforcing rib 38 which extends outwardly from the arcuate shell to a length which reaches the circular limit, extended, of the arc of the portion 37. From the edge 20*c*′ outwardly to the handle grip portion 24, the handle stem structure is of criss-cross form as shown in FIGS. 7, 8 and 9. The structure from the handle-attached edge 20*c*′ outwardly of the handle stem structure as shown in FIGS. 1, 2, 11 and 12 includes an open X-crossing structure criss-crossing repeated longitudinally at integrals between about one and one-eighth inches and one and one-half inches. The lower portion of this structure is an arcuate shell of a little more than semi-circular extent and concave upwardly as shown at 30 in FIGS. 7, 8 and 9. The criss-cross structure as clearly seen in FIGS. 7 and 9 extends from the arcuate shell upwardly of a length to reach the circular limit of the arcuate shell extended. In a preferred form, the x-crossing structure near the handle-attached edge 20*c*′ of the scoop is at 45°, and such x-crossing structure extends the longitudinal length of the handle stem structure and blends to a 30° structure farther out the handle stem toward the handle grip as best shown in FIG. 1.

Figure 14:
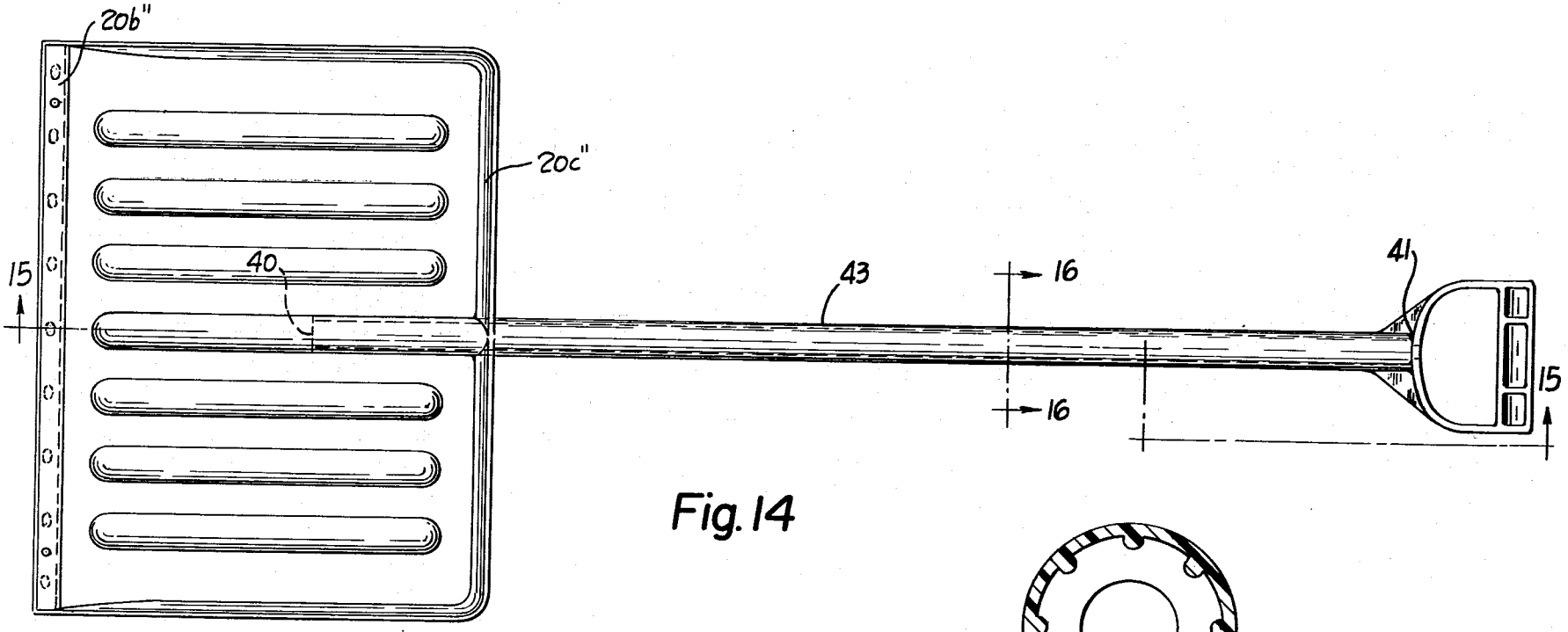
FIG. 14 is a plan view of a third embodiment of this invention.
Figure 16:
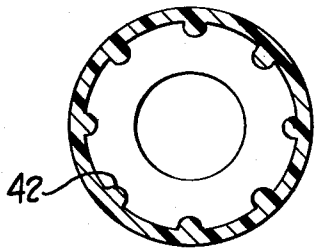
FIG. 16 is a sectional view enlarged, taken along the line 16—16 of FIG. 14.
Figure 15:
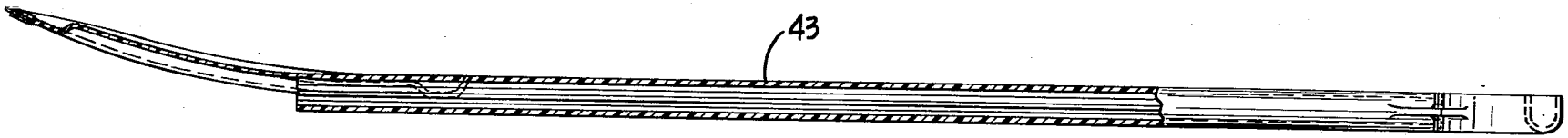
FIG. 15 is a sectional view taken along the line 15—15 of FIG. 14.

A third embodiment of this invention is shown in FIGS. 14, 15 and 16. Here all of the structure is the same as the first described embodiment in connection with FIGS. 1 and 2 with exception of the handle stem structure.

In FIGS. 14–16 the handle stem structure extending from a point 40 inwardly on the scoop about four to six inches from the handle-attached edge 20*c*″ to the handle grip member 41 is circular in outer dimension as seen at 43 in FIG. 14, with a hollow core providing a plurality of longitudinally extending reinforcing projections 42 extending a short distance radially inwardly as clearly seen in FIG. 16. This handle stem structure decreases in diameter continuously and regularly for the entire length from the point 40 to the handle grip member 41. This decrease in diameter gives an amount of draft permitting a forming core extending through the entire length to be removed longitudinally of the handle stem from the scoop end. As previously mentioned this draft might be 2°.

The handle grip portion of the embodiment shown in FIGS. 14, 15 and 16 may be like that shown in FIG. 14 or it may be like that shown in FIG. 1.

There is herein described therefore a one piece plastic injection molded snow shovel in which the blade or scoop, the handle stem structure and the D-shaped grip portion of the handle are molded in one operation and a finished unit may be produced from one cycle of the plastic injection molding machine. There is thus provided a snow tool having adequate strength characteristics to perform its function. This will elminate the necessity for assembly of any kind and putting together separate blades or scoops or separate handle structures and will reduce dependency on thirty-six inch ash dowels in the stem connection area. I have thus produced a relatively low cost snow shovel with adequate structural strength and stiffness. Certain features of the structure eliminate excessive weight. There is thus eliminated all labor costs associated with assembly of a plurality of parts.

What is claimed is:

1. A unitary snow shovel scoop with operative handle, comprising a generally planar rectangular scoop having a transverse linear leading edge opposite a handle-attached edge, a bifurcated reinforcement strip extending the entire length of said leading edge, a coacting flat linear metal strip firmly secured in the bifurcation of said reinforcement strip and extending beyond the front edge of said reinforcement strip, and a generally cylindrical hollow handle stem structure extending centrally of said scoop at right angles to said leading edge from a point on said scoop to a position on said handle stem for a handle grip spaced from said handle-attached edge, said hollow handle stem structure being integral with said scoop, said handle stem structure decreasing in diameter continuously and regularly for a length from a point a few inches inside of said handle-attached edge outwardly to said handle grip by an amount of draft permitting a forming core extending through said length to be removed longitudinally of said handle stem from said scoop end, and the hollow portion of said handle stem being cylindrical and having spaced longitudinally extending short reinforcing projections extending throughout said length.

2. A unitary snow shovel scoop with operative handle as defined in claim 1, wherein said handle stem structure extending from said handle-attached edge inward on said scoop for several inches consists of an arcuate shell extending through an arc of a little more than semi-circular opening downwardly together with a central diametrically extending integral rib of a length to reach the circular limit of said arc.

3. A unitary snow shovel scoop with operative handle as defined in claim 2, wherein said handle stem structure from said handle-attached edge outward consists of an arcuate shell on its lower face extending through an arc a little more than semi-circular opening upwardly, together with, on the upper face, an open X-crossing structure repeated longitudinally at intervals between about one and one-eight inches and one and one-half inches, said crossing structure of a length to reach the circular limit of said arc.

4. A unitary snow shovel scoop with operative handle as defined in claim 2, wherein said handle stem structure, extending for a length from said handle-attached edge inward on said scoop for several inches and outward from said last named edge for a space normally grasped by the hand of an acting shoveller, consists of an outer cylindrical shell having an inner generally cylindrical hollow surface having spaced longitudinal reinforcing projections extending a short distance radially inwardly, said last named length decreasing in diameter continuously and regularly by an amount of draft permitting a forming core extending through said length to be removed longitudinally of said handle stem from said scoop end.

5. A unitary snow shovel scoop with operative handle as defined in claim 4, wherein said handle stem structure from said length having longitudinal reinforcing projections outwardly consists of a lower arcuate shell extending through an arc of a little more than semi-circular opening upwardly, together with, on the upper face, an open X-crossing structure repeated longitudinally at intervals of about one and one-eight inches and one and one-half inches, said crossing structure of a length to reach the circular limit of said arc.

6. A unitary snow shovel scoop with operative handle as defined in claim 2, including a plurality of laterally spaced reinforcement ribs formed concavely upward in said upper surface of said scoop extending normally between said edges and including a central rib and evenly spaced generally parallel ribs laterally thereof, said ribs other than said central rib gradually increasing in depth from a minimum depth adjacent said leading edge to about one-half inch depth at a predetermined short distance from said handle-attached edge, said center rib ending at said upper surface toward said handle-attached edge, and a snow-retaining and reinforcing flange extending upwardly from the periphery of said scoop except for said leading edge.

* * * * *